US009156574B2

(12) United States Patent
Tobin et al.

(10) Patent No.: US 9,156,574 B2
(45) Date of Patent: Oct. 13, 2015

(54) APPARATUS FOR AND METHOD OF FILLING CONTAINER WITH SIMILAR ARTICLES

(75) Inventors: Jon S. Tobin, Pittsford, NY (US); Timothy Lemley, East Bethany, NY (US); Duane L. Hawkins, Rochester, NY (US); David A. D'Orazio, Macedon, NY (US); Scott C. Trescott, Livonia, NY (US); Mark W. VandeSande, Fairport, NY (US); Todd W. VandeSande, South Blend, NY (US)

(73) Assignee: Han-Tek, Inc., Victor, NY (US)

( * ) Notice: Subject to any disclaimer, the term of this patent is extended or adjusted under 35 U.S.C. 154(b) by 461 days.

(21) Appl. No.: 11/864,216

(22) Filed: Sep. 28, 2007

(65) Prior Publication Data

US 2009/0084462 A1 Apr. 2, 2009

(51) Int. Cl.

| | |
|---|---|
| ***B65B 35/12*** | (2006.01) |
| ***B65B 39/00*** | (2006.01) |
| *B65B 5/10* | (2006.01) |
| *B65B 39/12* | (2006.01) |

(52) U.S. Cl.

CPC ..... *B65B 35/12* (2013.01); *B65B 39/007* (2013.01); *B65B 5/101* (2013.01); *B65B 39/12* (2013.01)

(58) Field of Classification Search

USPC ..... 53/475, 57, 58, 74, 236, 244, 248, 260; 198/756

See application file for complete search history.

(56) References Cited

U.S. PATENT DOCUMENTS

| | | | | | |
|---|---|---|---|---|---|
| 30,465 | A | | 10/1860 | Curtiss | |
| 949,240 | A | * | 2/1910 | Merritt | 141/257 |
| 1,205,445 | A | | 12/1916 | Arnold | |
| 1,233,117 | A | | 7/1917 | Parker | |
| 2,114,104 | A | * | 4/1938 | Driscoll et al. | 141/73 |
| 2,142,990 | A | * | 1/1939 | Belcher | 141/44 |
| 2,299,572 | A | | 10/1942 | Estenes | |
| 2,468,497 | A | | 4/1949 | Johnaon et al. | |
| 2,805,841 | A | * | 9/1957 | Kyle | 198/756 |
| 3,105,592 | A | | 10/1963 | Cohen | |
| 3,254,755 | A | * | 6/1966 | O'Brien | 414/295 |
| 3,258,112 | A | * | 6/1966 | Allen et al. | 198/756 |
| 3,392,878 | A | | 7/1968 | Jackson | |
| 3,559,363 | A | * | 2/1971 | Lipp | 53/57 |

(Continued)

FOREIGN PATENT DOCUMENTS

| | | | |
|---|---|---|---|
| JP | 2003261111 | A | 9/2003 |
| KR | 2007007540 | A | 1/2007 |

OTHER PUBLICATIONS

International Search Report and Written Opinion for PCT/US2008/077881.

*Primary Examiner* — Christopher Harmon

(74) *Attorney, Agent, or Firm* — Andrew J. Anderson, Esq.; Harter Secrest & Emery LLP

(57) ABSTRACT

An apparatus for filling an upright container having a base and an open top with a number of similar articles from an elevated source includes an inlet and an auger assembly. The inlet is adapted to be proximate the elevated source of the similar articles such that the articles enter the apparatus therethrough. The auger includes a substantially helical ramp disposed about a shaft. The auger is rotatable about a longitudinal axis of the shaft and is translatable along the longitudinal axis. An end of the auger is disposed proximate the container and includes a discharge through which the articles are discharged into the container.

17 Claims, 6 Drawing Sheets

(56) References Cited

U.S. PATENT DOCUMENTS

| | | | | | |
|---|---|---|---|---|---|
| 3,661,211 | A | | 5/1972 | Powers | |
| 3,667,591 | A | * | 6/1972 | Sykes | 198/756 |
| 4,124,997 | A | * | 11/1978 | Sadjina et al. | 62/320 |
| 4,194,343 | A | * | 3/1980 | Myers et al. | 53/493 |
| 4,255,129 | A | * | 3/1981 | Reed et al. | 432/13 |
| 4,294,059 | A | | 10/1981 | Stilwell et al. | |
| 4,301,641 | A | * | 11/1981 | McElwain et al. | 53/493 |
| 4,922,687 | A | * | 5/1990 | Chow et al. | 53/472 |
| 4,944,334 | A | | 7/1990 | McGregor | |
| 5,016,886 | A | * | 5/1991 | Gould | 473/135 |
| 5,379,862 | A | | 1/1995 | Schmidt et al. | |
| 5,509,965 | A | | 4/1996 | Harry et al. | |
| 6,085,807 | A | | 7/2000 | Wright | |
| 6,098,677 | A | * | 8/2000 | Wegman et al. | 141/256 |
| 6,470,921 | B1 | * | 10/2002 | McGregor | 141/12 |
| 6,637,480 | B1 | | 10/2003 | Tobin et al. | |
| 2002/0100519 | A1 | * | 8/2002 | McGregor et al. | 141/264 |
| 2008/0149215 | A1 | * | 6/2008 | Patureaux et al. | 141/1 |

* cited by examiner

APPARATUS FOR AND METHOD OF FILLING CONTAINER WITH SIMILAR ARTICLES

FIELD OF THE INVENTION

The present invention relates to a method of and apparatus for filling containers with similar articles. More specifically, the invention provides an improved method of and apparatus for relaying articles dispensed from a source to a container positioned relatively below the source without damaging the articles.

BACKGROUND OF THE INVENTION

The present invention may be used in conjunction with a variety of items often found in a supply stream such as, for example, food products, building components, and manufacturing components. However, the present application is particularly useful with preforms. Preforms are typically formed of a thermoplastic and are the initial material for thinwall containers such as bottles for soft drinks, detergents, etc. produced with blow molding machines.

In one method of blow molding plastic containers, such as polyethylene terephthalate (PET) carbonated beverage bottles, a preform first is formed by injection molding followed by reheating and stretch blow molding of such preforms into a container. The preforms are generally cylindrical tubes having a hemispherical closed end and an opposite, open end having a ring shaped shoulder and threaded sleeve. Superficially, preforms generally resemble test tubes having a threaded end.

Depending upon the size of the container to be blow formed, the preforms have different sizes, particularly in length and wall thickness, whereas the thread diameters are somewhat standardized with reference diameters being 22, 28, and 38 mm, measured on the outside of the thread.

The preforms are injection molded in large numbers at an injection molding machine, which includes a preform handling or cooling plate. After the preforms are removed from the injection molding machine, they are brought to an elevated position by a conveyor belt and then delivered by a chute to a large corrugated cardboard, plastic, or steel box normally identified as a "gaylord" for storage and shipment. The preforms merely drop from the chute into the gaylord. Since the gaylord may be four or more feet tall and the chute discharge is at a still higher elevation, a drop from the chute to the bottom of the gaylord may be 5 feet or more.

Surface damage to the preform typically occurs during dropping through such distances into the gaylord. Such damage is manifested by scratching or scuffing of the surface of the preform, or, and in an extreme case, in the chipping of a threaded surface. Since this damage occurs during loading of the articles, which is generally after inspection, the damage often goes undetected. Consequently, such defects on the exterior surface of a preform result in a blow molded container having an unacceptable surface contusion. Such containers generally are not fit for sale and must be discarded, as consumers prefer not to purchase damaged products.

A number of methods have been applied to reduce the surface damage to preforms prior to the final blow molding process. Specifically, U.S. Pat. No. 5,509,965 discloses immediately coating preforms after injection molding of such preforms to prevent damage of the preforms by engagement with one another. However, this process, like many other processes used heretofore, typically requires additional materials and processing equipment, thereby adding to the cost of forming and handling the preforms.

U.S. Pat. No. 6,637,480 provides another method for handling performs. Namely, that patent discloses a variable volume height adjustable buffer for transferring items from an elevated supply stream to a lower container. The '480 patent is assigned to the same assignee as this application, and the apparatus and methods disclosed therein are effective at filling gaylords with provided preforms by using an expandable buffer.

However, there remains a need in the art for a system that can transfer, with minimal or no damage, preforms from the injection mold supply stream into relatively lower containers for storage and transport.

There also is a need in the art for a system for loading a multitude of similar articles into relatively deep containers that minimizes damage to the articles particularly where the articles are dropped from a relatively high elevation relative to the bottom of the container.

There also is a need for such a system for loading a multitude of similar articles into a deep container wherein the drop or fall distance into the container is kept relatively constant regardless of the container height.

There also is a need for a system for loading a multitude of similar articles into a deep container wherein the articles are distributed relatively evenly throughout the container, to minimize localized piling of the articles.

SUMMARY OF THE INVENTION

The present invention remedies the foregoing needs in the art by providing an apparatus for, system for, and methods of dropping articles from relatively higher positions to a container at a relatively lower position while reducing damage to the articles caused by dropping.

In one aspect of the invention, an apparatus for filling an upright container having a base and an open top with a number of similar articles from an elevated source includes an inlet and an auger assembly. The inlet is adapted to be proximate the elevated source of the similar articles such that the articles enter the apparatus therethrough. The auger includes a substantially helical ramp disposed about a shaft. The auger is rotatable about a longitudinal axis of the shaft and is translatable along the longitudinal axis. An end of the auger is disposed proximate the container and includes a discharge through which the articles are discharged into the container.

In another aspect, the invention provides a system for filling one or more containers with a plurality of similar articles. The system includes a source of the articles, an auger assembly, and a container. The source of the articles includes an elevated outlet through which the articles are discharged. The auger assembly includes an inlet and an auger. The inlet is disposed proximate the elevated outlet of the source. The auger includes a substantially helical ramp disposed about a shaft. The auger is rotatable about an axis of the shaft and translatable along the axis. An end of the auger includes a discharge. The container is disposed proximate the discharge of the auger for receiving articles discharged from the auger. The auger is translatable along the axis to vary the distance between the auger discharge and the bottom of the container.

Yet another aspect of the invention features a method of filling a container with a plurality of similar articles. The method includes a step of dispensing the articles from an elevated source. The method also includes the step of providing an auger assembly having an inlet and an auger, the inlet disposed proximate to the elevated source and the auger being rotatable relative an axis thereof and being translatable in a substantially vertical direction. The articles are lowered along the auger to a discharge of the auger. The discharge of the auger is located at an initial position relative to a bottom of the container to establish a drop distance between the discharge and the bottom of the container, and the discharge is raised in response to the entry of the articles into the container to maintain the drop distance between the supply source and an average fill level of the articles in the container substantially constant.

An understanding of these and other aspects and features of the present invention may be had with reference to the attached figures and following description, in which the present invention is illustrated and described.

BRIEF DESCRIPTION OF THE DRAWING FIGURES

Figure 2:
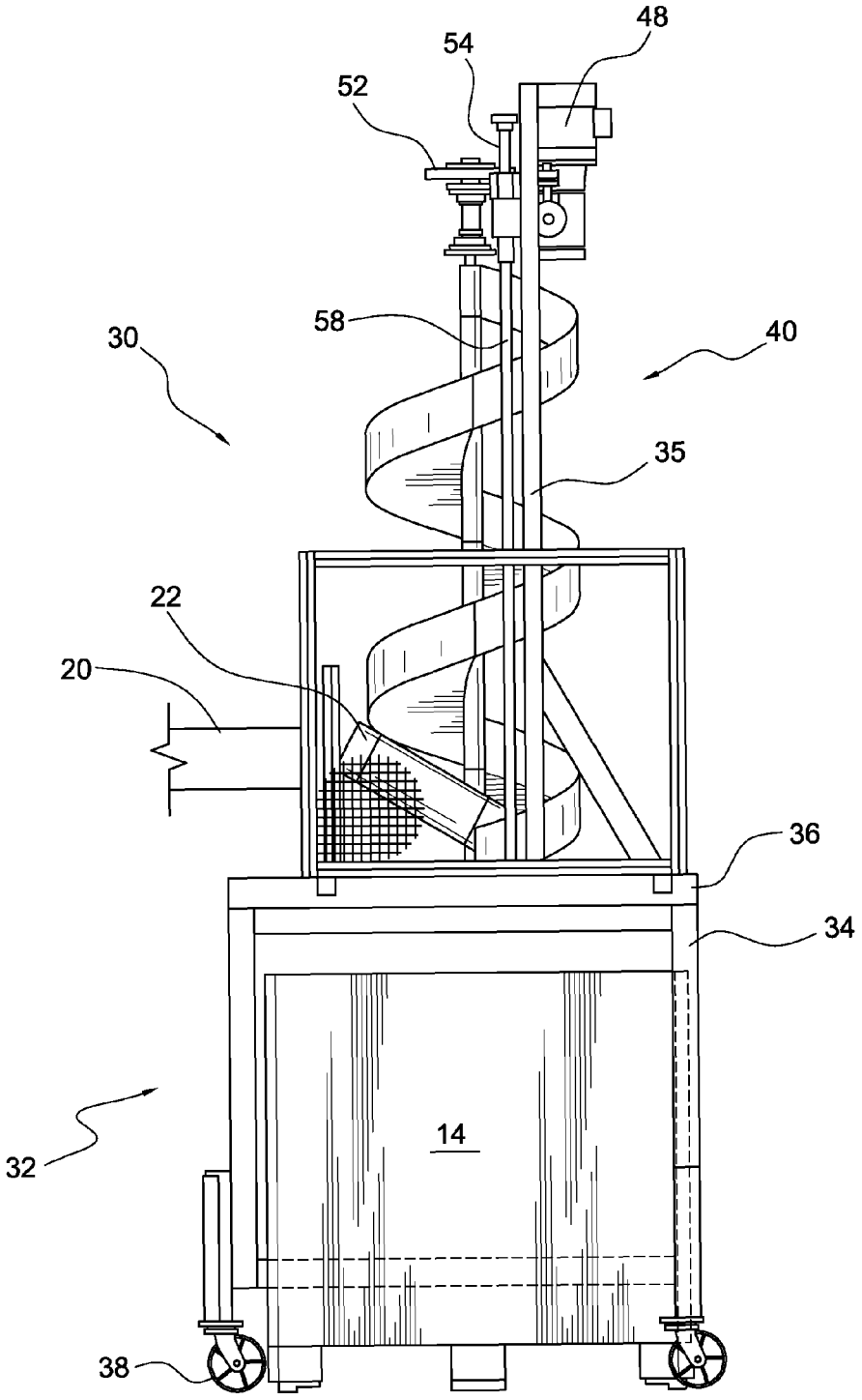
FIG. 2 is an elevational view of a material handling apparatus according to a preferred embodiment of the invention.
Figure 3C:
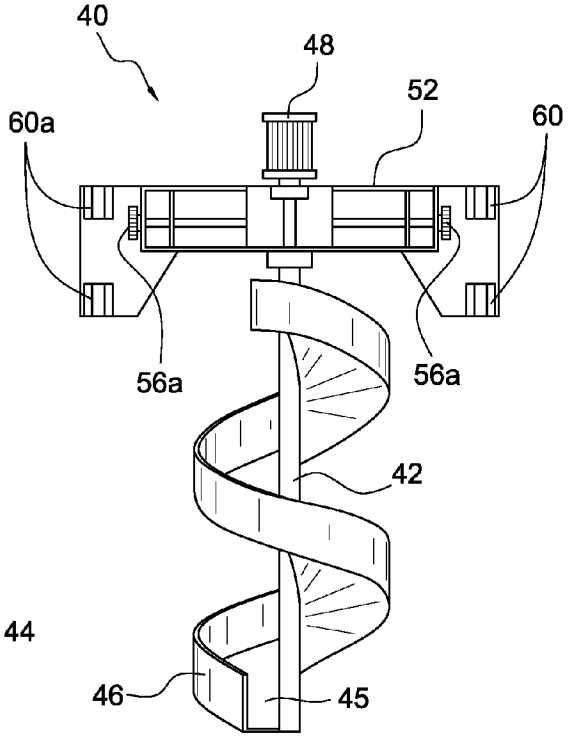
Figure 3B:
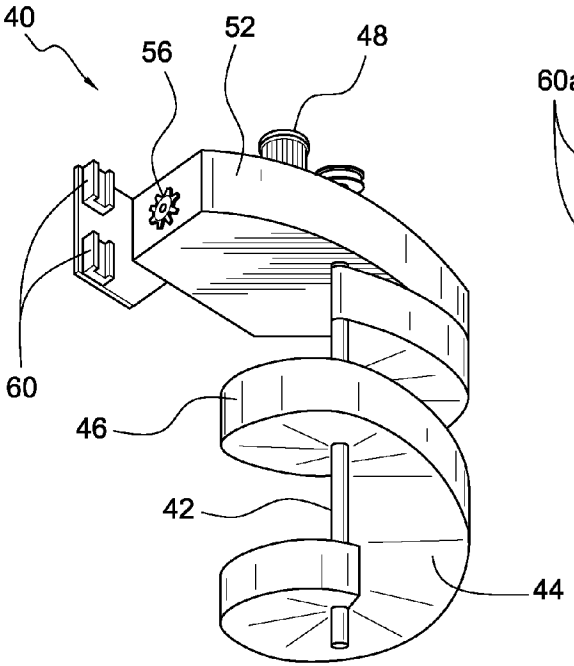
Figure 3A:
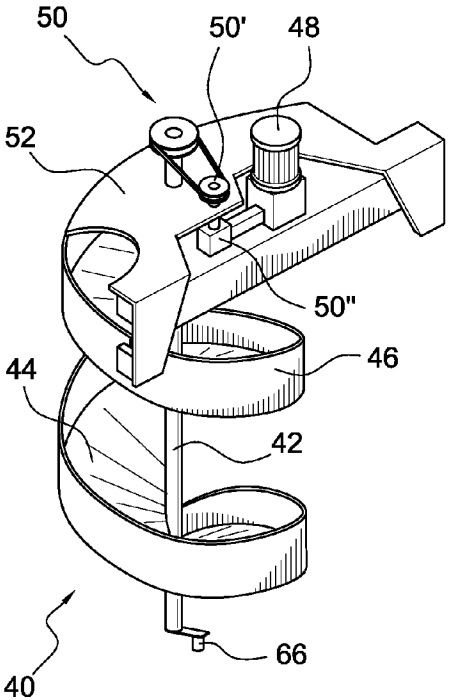

FIGS. 3A, 3B, and 3C are, respectively, a front perspective view, a rear perspective view, and a front elevation view of an auger assembly as used in the apparatus of FIG. 2.

Figure 4C:
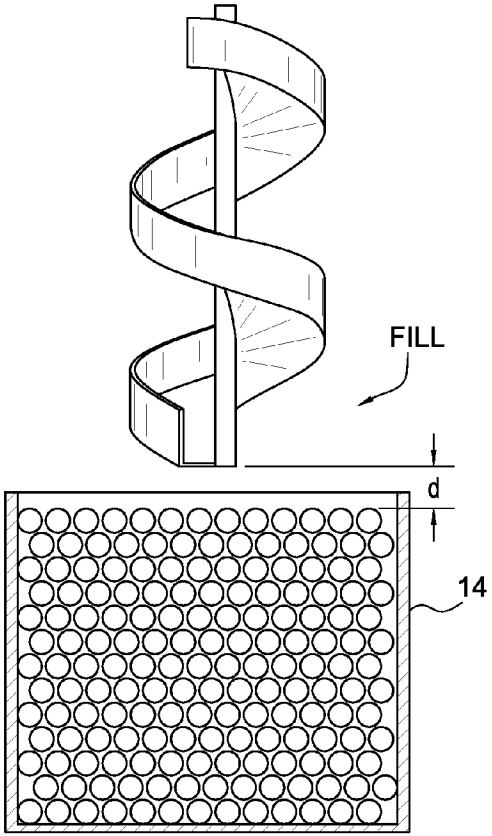
Figure 4B:
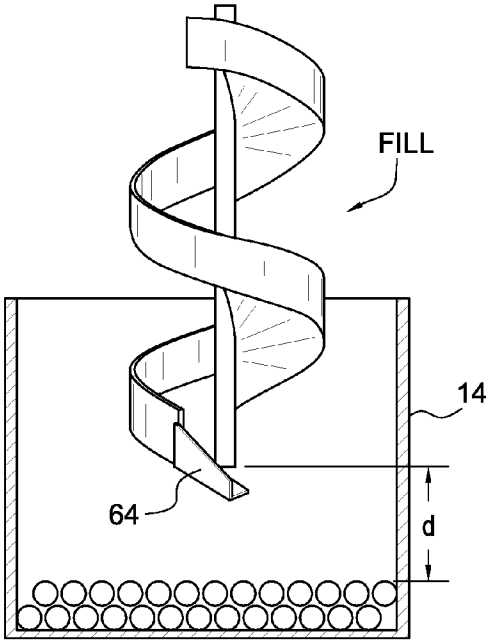
Figure 4A:
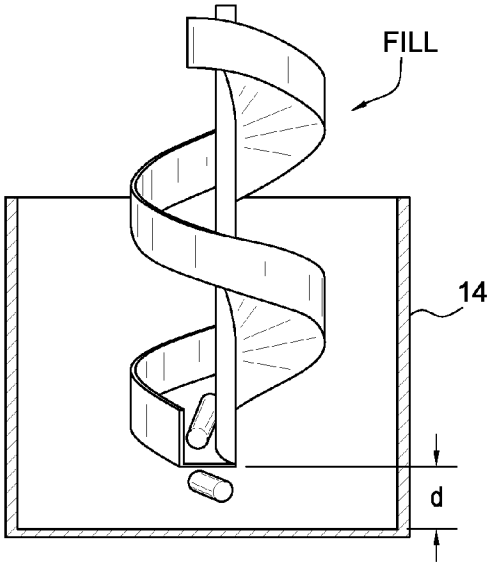

FIGS. 4A-4C illustrate a process of filling a gaylord with similar articles according to a preferred embodiment of the present invention.

Figure 5B:
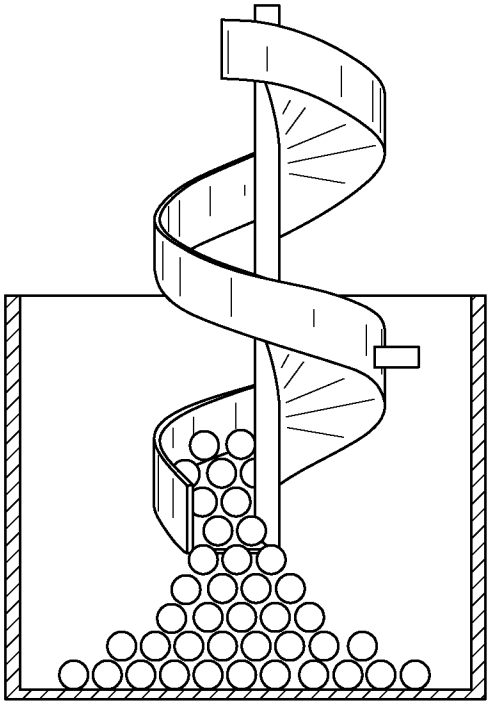
Figure 5B:
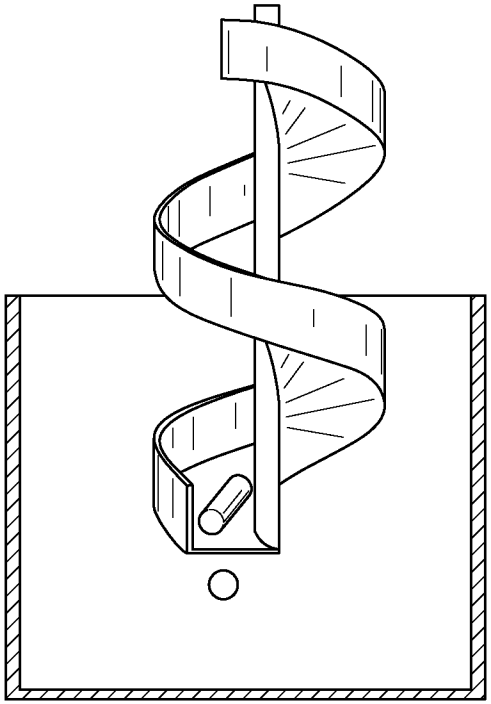

FIGS. 5A and 5B illustrate a process of filling a gaylord with similar articles according to another preferred embodiment of the present invention.

Figure 6:
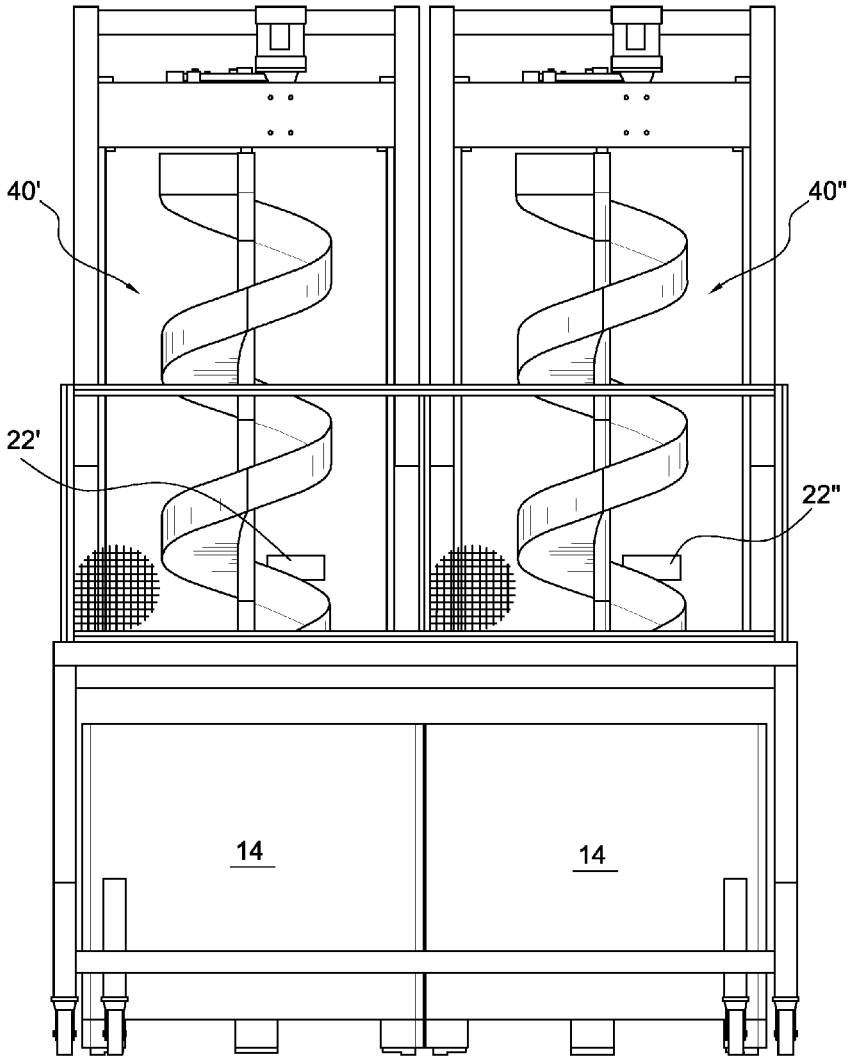

FIG. 6 is an elevation view of a material handling apparatus according to another preferred embodiment of the invention.

DETAILED DESCRIPTION OF THE INVENTION

Preferred embodiments of the invention now will be described with reference to the figures.

Figure 1:
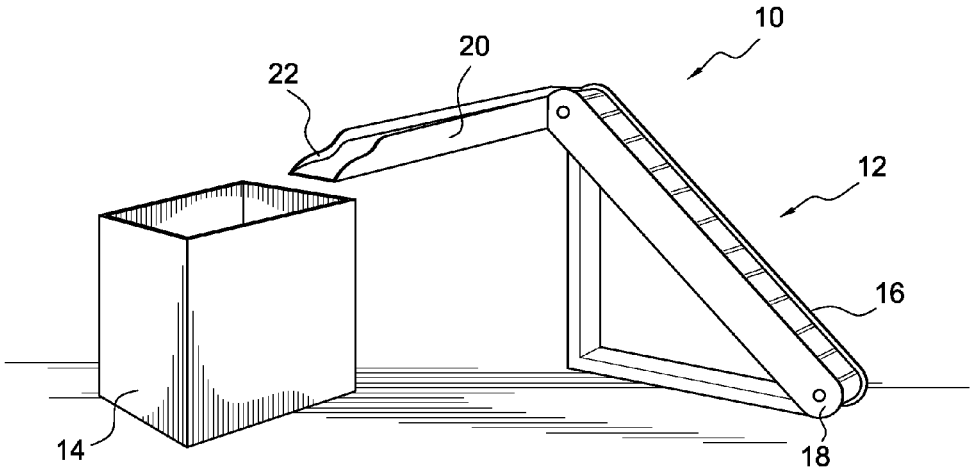
FIG. 1 (PRIOR ART)
FIG. 1 is a perspective view of a conventional material handling apparatus.

FIG. 1 depicts a conventional handling apparatus 10, which is used in association with a loading apparatus 12 and a gaylord container 14 to be filled. The loading apparatus 12 generally includes a conveyor 16 that receives articles at a relatively lower end 18 and transports the articles to an adjacent, elevated horizontal conveyor 20. The horizontal conveyor 20 conveys the articles to a chute 22, which dispenses the articles into the gaylord 14. Once full with the articles, the gaylord container is removed and replaced with an empty gaylord container.

As noted above, the conventional apparatus 10 generally is not desirable because it allows the preforms to fall a great distance, which can result in damage to the preforms or bouncing of the preforms out of the gaylord 14. The present invention remedies the deficiencies of the conventional system by providing a handling apparatus 30 that acts as an intermediary between the chute 22 and the gaylord 14, and alleviates the problem of having the preforms fall such a great distance.

As illustrated in FIGS. 2 and 3, the handling apparatus 30 generally includes a support structure 32 formed by a plurality of upright legs 34 and a top bracket 36 connecting the legs 34. The support structure 32 may also include additional horizontal, vertical, angled or other members which may provide a sturdier construction, additional functionality or the like. The support structure generally defines a housing or a cage which supports and/or surrounds the features of the invention, to be described in more detail below. The legs 34 preferably are sufficiently spaced such that a gaylord 14 may be received therebetween. Casters 38, wheels or the like also may be provided on bottom surfaces of one or more of the legs 34 to facilitate movement of the handling apparatus 30.

As illustrated in FIG. 2, the handling apparatus 30 further includes an auger assembly 40. The auger assembly 40 is illustrated in FIGS. 3A-3C in more detail. The auger assembly 40 generally includes a shaft 42 and a helical ramp 44 disposed about and along the shaft 42. In the preferred embodiment, the shaft 42 is disposed generally vertically, with the helical ramp 44 extending substantially radially from an outer surface of the shaft 42. The helical ramp 44 preferably has a constant pitch that is defined by an incline of the ramp and which is anywhere from between 1° and 89° relative a plane normal to a longitudinal axis of the shaft 42. A pitch of between about 10° and about 35° is preferred. Alternatively, the pitch may vary along the length of the ramp. Sides 46 preferably are provided upstanding from the outer, i.e., radially remote relative the shaft 42, edge of the helical ramp 44. As will be described in more detail below, the bottom of the helical ramp terminates in a discharge 45.

Disposed in communication with the shaft 42 is an actuator 48, such as a motor or the like, that imparts a torque on the shaft 42, causing the shaft 42 to rotate. As noted above, the helical ramp 44 is fixed to the shaft 42, such that when the shaft 42 is driven, the shaft 42 and the ramp 44 co-rotate in a manner similar to an auger. As illustrated in the Figures, at least one additional transmission mechanism 50 also may be used to relay power from the actuator 48 to the shaft 42. For example, as illustrated in FIGS. 3A-3C, the transmission mechanism 50 includes a gearbox 50' and a belt and pulley arrangement 50". Other or additional known transmission implementations may be used to link the output of the actuator 48 to the shaft 42. Alternatively, the actuator 48 may be directly coupled to the shaft 42.

The handling apparatus 30 preferably also includes a stage 52 on which one or more of the actuator 48, the transmission mechanism 50, and the shaft 42 are mounted. The stage 52 is vertically translatable relative to the support structure 32. In the preferred embodiment, gears 56*a*, 56*b* are disposed on the stage 52 to respectively register with a plurality of teeth on first and second racks 54 provided on two spaced upstanding members 35. When the gears 56 are turned, e.g., by actuation of the actuator 48 and via a transmission, the teeth on the gears 56 cooperate with the teeth of the respective racks 54 to selectively move the stage 52 either up or down. First and second support rails 58 preferably also are provided on the spaced upright members 35, and first and second pairs of open bore bearings 60a, 60b are disposed on the stage 52 to cooperatively engage with the support rails 58. These rails 58 facilitate smooth vertical movement of the stage 52.

In this preferred embodiment of the invention, the actuator 48 is used as the power source both to impart rotation on the shaft and to rotate the gears that work with the racks to impart vertical translation of the stage. In this manner, depending upon the transmission and timing implementations used, it will be appreciated that the stage is moved vertically whenever the shaft is rotated, and vice versa. However, in other preferred embodiments of the invention, the rotation of the shaft and the translation of the stage may not be linked. For example, the actuator 48 may be used only to impart one of rotation on the shaft and translation on the stage, with a second actuator (not shown) being used to impart the other of the rotation of the shaft and translation of the stage. Preferably, however, the translation of the stage and the rotation of the shaft are synchronized such that the segment of the helical ramp disposed proximate the chute is oriented substantially the same regardless of the height of the stage. In this manner, the ramp is always arranged to receive the articles being discharged from the chute.

In still other embodiments of the invention, means other than the racks and gears may be used to vertically translate the stage 52. Such means may include a system including pulleys, belts, or the like, or may include a direct force imparted by a translational actuator or the like. These and other means are believed to be within the level of ordinary skill in the art.

The auger assembly 40 preferably is contained within the footprint of the four upright legs 34 and is disposed above a gaylord 14 also contained substantially within the footprint of the four upright legs 34. Because the stage 52 is disposed for vertical movement, the shaft 42 and helical ramp 44 move vertically with respect to the gaylord 14, in and out of the gaylord 14.

The chute 22 preferably is arranged proximate, but not touching, the helical ramp 44, and acts as the conduit to discharge preforms onto the helical ramp 44.

The chute preferably is disposed proximate the ramp and a sufficient distance from the ramp that preforms falling from the chute onto the ramp are retained on the ramp. In addition, an obstruction, for example, a brush, a moveable flap, or the like may be provided to cooperate with the chute. Specifically, this obstruction slows preforms prior to falling onto the ramp to aide in ensuring that the preforms do not hit the ramp with sufficient force to bounce off the ramp or to cause damage upon contacting the ramp. Once on the ramp, the preforms spiral down the ramp into the gaylord.

A preferred method of filling a gaylord 14 with preforms now will be described with reference to FIGS. 4A-4C.

Initially and with the stage 52 at its highest position, an empty gaylord 14 is placed in the space between the upright legs 34, below the auger assembly 40. The stage 52 preferably then is lowered to an initial position, at which the discharge 45 of the helical ramp 44 is separated from the bottom of the gaylord 14 by a preferred drop distance. This drop distance is a distance that the preforms can safely fall without being marred, and is labeled with reference letter d in FIGS. 4A-4C. The chute 22 from the loading apparatus 10 is positioned above the helical ramp 44, with the distance between the chute 22 and the ramp 44 not exceeding the drop distance. The initial position is illustrated in FIG. 4A.

In this position, the preforms are allowed to fall from the chute 22 onto the ramp 44, where they then descend down the helical ramp 44, and eventually fall into the gaylord 14. As the preforms begin to accumulate in the gaylord 14, the distance between the bottom of the helical ramp 44 and an average fill level of the preforms decreases, and becomes increasingly less than the drop distance. As the drop distance lessens, the actuator 48 is powered to raise the stage 52, thereby raising the shaft 42 and the helical ramp 44. Raising the shaft 42 and the helical ramp 44 increases the distance between the discharge 45 of the helical ramp 44 and the top of the preforms closer to the drop distance, and thus allows more preforms to accumulate below the helical ramp 44.

As should be understood from the foregoing discussion, when the stage 52 is raised, the shaft 42 and the helical ramp 44 rotate. This translation and rotation preferably are synchronized to maintain the position of a portion of the helical ramp 44 proximate the chute 22 with respect to the chute 22. Put another way, regardless of the height of the shaft 42, the ramp should be aligned with respect to the chute to receive preforms from the chute. Moreover, the rotation of the bottom of the helical ramp 44 causes the preforms to be discharged in different directions into the gaylord 14, dispersing the preforms throughout the entire gaylord 14.

The stage 52 is raised in this manner until the gaylord 14 is relatively full, at which time the discharge of preforms is stopped. When full, the discharge 45 of the helical ramp 44 preferably is above the top of the gaylord 14 (or is subsequently moved to a position above the top of the gaylord 14) such that the full gaylord 14 may be removed for shipping and/or for additional processing. At this time, an empty gaylord replaces the full gaylord, the stage is lowered back to the start position, and the new gaylord is filled in the same manner.

Control of the actuator and thus the movement of the auger assembly may be achieved in a number of ways. For instance, in one embodiment, a sensor 66 may be placed proximate the bottom of the helical ramp to sense a presence of preforms, the bottom of the gaylord, and/or any other obstruction. This presence then will trigger activation of the actuator. In an alternative embodiment, the sensor disposed on the bottom of the helical ramp is not used to sense proximity of preforms. In some embodiments the sensor may not be used at all.

An alternative method for filling the gaylord with performs is illustrated in FIGS. 5A and 5B. This method includes arranging the discharge of the helical ramp proximate the bottom of the gaylord (FIG. 5A) and allowing preforms to flow freely down the helical ramp without moving the helical ramp. In this manner, preforms will initially begin to fill the gaylord, but will eventually begin to backup along the length of the helical ramp (FIG. 5B). In this embodiment, a sensor 66 may be disposed somewhere along the length of the ramp such that when presence of performs is sensed at that chosen position, the actuator is controlled to actuate, thereby moving the ramp vertically upward and rotationally. It is envisioned that the sensor could be located proximate the discharge of the helical ramp or it may be anywhere along the helical ramp. Moreover, it may be possible to allow preforms to queue along substantially the entire length of the ramp, and even back up into the chute proximate the conveyor. For example, in one embodiment, a sensor may be arranged on the chute when one or more performs are detected by the sensor, the actuator is actuated. In these alternative embodiments, preforms are allowed to essentially queue up in the discharge ramp such that when the ramp is rotated, the preforms essentially flow into the gaylord as a continuous group of preforms, rather than fall into the gaylord one at a time. As just described, it may be possible to allow queuing of the preforms in the discharge ramp by stopping the movement of the ramp and allowing preforms to back up in the ramp, at which time the ramp is moved. Alternatively, the ramp may continuously move, but at such a slow rate compared to the rate at which the preforms are entering that the preforms still are allowed to back up in the ramp.

Other methods of controlling movement of the auger assembly also are contemplated. For example, instead of detecting a presence or absence of one or more preforms, a counter may be used such that the actuator is actuated when a certain number of preforms has passed onto the chute. Alternatively, a timer may be used to actuate the actuator after some amount of time has elapsed. The actuator also could be manually controlled by an operator, for example, when the operator views that it would be beneficial to move the auger assembly.

Although several of the foregoing control schemes do not require a sensor disposed at the bottom of the helical ramp to detect presence of performs, it is contemplated that a sensor may still be used at the bottom of the discharge, for example, to ensure that the ramp is not dropped into a full gaylord. In this manner, the sensor would detect the presence of a preform underneath, and would not allow the ramp to be moved vertically downwardly thereby crushing the preforms.

Although, as described above, the chute preferably is arranged proximate the ramp such that preforms drop onto the ramp without bouncing off, alternative measures also may be taken to ensure smooth transition of the preforms onto the helical ramp. For example the handling apparatus 30 preferably also may include a guard fixed relative to the support structure 32. The guard preferably is disposed below the discharge of the chute 22 and circumscribes at least a portion of the helical ramp 44. The guard has a sufficient height that preforms falling onto the ramp 44 and bouncing off the ramp 44 will contact the guard and be retained on the ramp. The guard may be substantially semi-circular, to substantially surround the helical ramp. However, other shapes may be used without departing from the scope of the invention.

In another alternative embodiment, a fixed ramp is fixed to the support structure 32 and disposed proximate the helical ramp. The fixed ramp preferably has a pitch that is substantially the same as the pitch of the helical ramp, but the fixed ramp preferably has a reverse ramp pitch. In the preferred embodiment, the helical ramp 44 is a counter-clockwise spiral and the fixed ramp has a clockwise spiral. Of course, the orientations could be switched. Because the fixed ramp is angled in a direction opposite the angle of the helical ramp 44, a convergence is formed between the helical ramp 44 and the fixed ramp. Horizontal and vertical distances between the lowest part of the fixed ramp and an adjacent part of the helical ramp 44 are sufficient that performs pass through the convergence, and are not hung up on or pinned between the fixed ramp and/or the helical ramp 44. In addition to providing a convergence for the preforms, the fixed ramp also decreases the distance that a preform would fall between the chute 22 and the portion of the helical ramp 44 below the fixed ramp.

As illustrated in FIG. 6, another preferred embodiment of the invention utilizes two auger assemblies 40', 40", to substantially eliminate the downtime caused by removing the full gaylord and replacing an empty gaylord. In this embodiment, a plurality of chutes 22', 22" are provided on the horizontal conveyor, each aligned with one of the two auger assemblies 40', 40". A gate or the like (not shown) preferably operates in cooperation with one or more of the chutes to selectively direct preforms onto or away from the chutes 22', 22". Initially, preforms are directed to the first chute 22', such that performs fall into the gaylord disposed below the first auger assembly 40'. When the gaylord disposed below the first auger assembly 40' is full, the flow of preforms onto the chute 22' is stopped and the preforms are allowed to flow onto the chute 22" cooperating with the second auger assembly 40", such that the gaylord disposed below the second auger assembly 40" can be filled. Thus, while the full gaylord is removed and replaced with an empty gaylord, and the stage 52 of the first gaylord auger assembly 40' is subsequently moved to the start position inside the gaylord, the gaylord beneath the second auger assembly 40" is allowed to fill.

In another embodiment, a single chute 22 is provided that preferably is selectively movable from a first position proximate the first auger assembly 40' to a second position proximate the second auger assembly 40". The chute may be moved to selectively cooperate with the first and second auger assemblies 40', 40" in any of a number of ways. In one embodiment, some or all of the loading apparatus may be movable. Alternatively, the chute 22 may have, or cooperate with, two outlets, one aligned with each of the auger assemblies. In this embodiment, a gate or the like preferably is provided to selectively allow discharge from either of the two outlets. Other methods of and means for selectively supplying the discharge to each of the two auger assemblies will be readily understood by those of ordinary skill in the art.

In any of the foregoing embodiments, while the gaylord is being filled, the actuator 48 may be constantly moving, i.e., to constantly move the stage 52 and drive the shaft 42, or the actuator may be moved iteratively. Factors affecting how the actuator 48 is driven may include, but are not limited to, the pitch of the ramp, the size of the gaylord, the rate of discharge of preforms from the conveyor, the size of the performs and the desired queue of performs on the ramp, if any. Moreover, the timing of the raising of the stage 52 may be synced to the conveyor. In one embodiment, the sensor 66 may be used to detect a distance between the helical ramp and the preforms in the gaylord 14. For example, and as shown in FIG. 3A a solid-state sensor may be affixed to the bottom of the shaft or to the helical ramp. Such a solid-state sensor senses a presence of a preform proximate the sensor, and instructs (through appropriate, known controls) an actuation of the actuator to increase the distance between the discharge of the helical ramp 45 and the average fill level of the performs closer to the drop distance.

As will be appreciated, discharge of preforms from the ramp generally would result in localized piling of the preforms directly below the end of the helical ramp. However, because the ramp is rotating, the location at which the preforms are discharged is continuously changing, thereby spreading the preforms substantially evenly throughout the gaylord. In the preferred embodiment, an extension 64 (shown in FIG. 4B) or the like may be provided on the discharge of the ramp to direct the preforms into corners or other peripheral regions of the gaylord. It may also be advantageous to provide a means for leveling off a top of the pile of preforms, for example, to obtain a true reading of the distance between the bottom of the ramp and the top of the preforms. To this end, an arm may be provided fixed vertically relative to the shaft. In this manner, the arm contacts the tops of the preforms and rotates with the shaft to spread the preforms evenly throughout the gaylord. The arm may include a flap or the like that contacts the tops of the performs.

In a preferred embodiment of the invention, the components of the handling apparatus generally are made of metal, which may include stainless steel, aluminum, or any other known metals. However, the parts may be alternatively made of any known materials, including, but not limited to, glass, ceramic, plastic, and wood. The materials preferably are selected for their durability, and to reduce weight. Moreover, the materials used may be selected and or coated to further reduce marring of the preforms. This may be particularly relevant for the materials comprising the shaft, the helical ramp, the fixed ramp, and the guard, as these are, the components most likely to contact the preforms.

As described herein, in the preferred embodiment, the articles to be used in the invention are preforms produced by a conventional apparatus, such as an injection molding machine (not shown). Although the term "preform" generally is used throughout the specification, it is understood that the invention may be useful for handling articles other than preforms. The invention is not limited to handling preforms. Any number of articles supplied in a supply stream may be used in conjunction with the invention.

Of course, the articles also may be supplied by something other than a conveyor. The loading apparatus 10 described above merely is provided as one means for introducing the articles at an elevated position. Other means, such as, but not limited to, hoppers, manual feeding, and agitators, will be readily known to those of ordinary skill in the art and may be used in conjunction with the present invention.

The foregoing embodiments of the invention are representative embodiments, and are provided for illustrative purposes. The embodiments are not intended to limit the scope of the invention. Variations and modifications are apparent from a reading of the preceding description and are included within the scope of the invention. The invention is intended to be limited only by the scope of the accompanying claims.

We claim:

1. An apparatus for filling an upright container with a number of similar articles from an elevated source, the container having a base and an open top, the apparatus comprising:

an auger comprising a substantially helical ramp disposed about a shaft, the auger being rotatable about a longitudinal axis of the shaft and translatable along the longitudinal axis, the auger being arranged proximate the elevated source to receive the articles from the source, and an end of the auger comprising a discharge through which the articles are discharged into the container, the auger being selectively translatable along the longitudinal axis between a first position in which the discharge is disposed relatively closer to a bottom of the container and a second position in which the discharge is disposed relatively farther from the bottom of the container, translation of the auger between the first position and the second position maintaining a non-zero drop distance between the discharge and a fill level of the articles in the container.

2. The apparatus according to claim 1 further comprising at least one actuator for one or both of rotating the auger about the longitudinal axis of the shaft and translating the shaft along the longitudinal axis.

3. The apparatus according to claim 1, wherein translation of the auger maintains a substantially constant non-zero drop distance.

4. The apparatus according to claim 1, wherein the auger further comprises peripheral sides for maintaining the articles on the auger during descent into the container.

5. The apparatus according to claim 1, further comprising a gate selectively allowing passage of articles onto the ramp.

6. The apparatus of claim 1, further comprising a guard circumscribing a portion of the auger.

7. The apparatus of claim 1, further comprising a sensor arranged proximate the discharge to detect one of a presence and an absence of the articles.

8. A system for filling one or more containers with a plurality of similar articles, the system comprising:

a source of the articles comprising an elevated chute through which the articles are discharged;

an auger assembly comprising an auger having a substantially helical ramp disposed about a shaft, the auger being rotatable about an axis of the shaft and translatable along the axis, an end of the auger comprising a discharge, and the auger being disposed proximate the chute to receive on the helical ramp articles discharged from the source; and a container disposed proximate the discharge of the auger for receiving articles discharged from the auger, wherein the auger is selectively translatable along the axis between a first position in which the discharge is disposed relatively closer to a bottom of the container and a second position in which the discharge is disposed relatively farther from the bottom of the container, translation of the auger between the first position and the second position maintains a non-zero drop distance between the discharge and a fill level of the articles in the container.

9. The system of claim 8, wherein the auger is translatable to maintain a substantially constant distance between the auger discharge and a fill level of the articles in the container.

10. The system of claim 8, wherein the auger further comprises peripheral sides for maintaining the articles on the auger during descent into the container.

11. The system of claim 8, further comprising a gate cooperating with the chute to selectively allow passage of articles from the source to the auger assembly.

12. The system of claim 8, wherein more than one auger assembly and more than one container are provided, the system further comprising a diverter for selectively allowing passage of the articles from the source to a selected one of the more than one auger assembly.

13. The system of claim 8, wherein the source is movable between two auger assemblies, each auger assembly having a corresponding container.

14. An apparatus for filling an upright container with a number of similar articles from an elevated source, the container having a base and an open top, the apparatus comprising:

an auger comprising a substantially helical ramp disposed about a shaft, the auger being rotatable about a longitudinal axis of the shaft and translatable along the longitudinal axis, the auger being arranged proximate the elevated source to receive the articles from the source, and an end of the auger comprising a discharge through which the articles are discharged into the container, the auger being selectively translatable along the longitudinal axis between a first position in which the discharge is disposed relatively closer to a bottom of the container and a second position in which the discharge is disposed relatively farther from the bottom of the container; and a peripheral side disposed on and extending upward from the ramp and radially spaced from the shaft, the peripheral side terminating at the discharge, at the end of the ramp.

15. The apparatus according to claim 14 further comprising at least one actuator for one or both of rotating the auger about the longitudinal axis of the shaft and translating the shaft along the longitudinal axis.

16. The apparatus according to claim 14, wherein the shaft of the auger is disposed substantially vertically and the auger is vertically translatable to maintain a substantially constant drop distance between the discharge and a fill level.

17. The apparatus of claim 14, further comprising a sensor arranged proximate the discharge to detect one of a presence and an absence of the articles.

* * * * *